US005999764A

United States Patent [19]

Okabayashi et al.

[11] Patent Number: 5,999,764

[45] Date of Patent: Dec. 7, 1999

[54] FIXING APPARATUS HAVING A TRANSPORT MECHANISM AND A CONTROLLER FOR CONTROLLING THE TRANSPORT MECHANISM

[75] Inventors: Eiji Okabayashi, Toyokawa; Yuusuke Morigami, Toyohashi, both of Japan

[73] Assignee: Minolta Co., Ltd., Osaka, Japan

[21] Appl. No.: 09/274,929

[22] Filed: Mar. 23, 1999

[30] Foreign Application Priority Data

Mar. 23, 1998 [JP] Japan ..... 10-074532

[51] Int. Cl.[6] ..... G03G 15/20

[52] U.S. Cl. ..... 399/67; 219/216; 399/68; 399/329

[58] Field of Search ..... 399/329, 67, 69, 399/70, 68; 219/216

[56] References Cited

U.S. PATENT DOCUMENTS 5,300,999 4/1994 Koh et al. ..... 399/329
5,778,294 7/1998 Hiraoka et al. ..... 399/329
5,842,079 11/1998 Miyamoto et al. ..... 399/329 X
5,847,361 12/1998 Yonekawa et al. ..... 399/69 X
5,857,136 1/1999 Yoneda et al. ..... 399/329

FOREIGN PATENT DOCUMENTS 6-318001 11/1994 Japan .
9-230727 9/1997 Japan .

*Primary Examiner*—Susan S.Y. Lee
*Attorney, Agent, or Firm*—Burns, Doane, Swecker & Mathis, LLP

[57] ABSTRACT

A fixing apparatus that supports an endless belt by rollers, forms a nipping area with a pressuring roller contacting outside periphery of the belt, and fixes unfixed images on sheets that are transported into the nipping area, the fixing apparatus characterized in that transportation of the sheets into the nipping area is prohibited until the minimum belt temperature detected by a temperature sensor reaches a fixing approval temperature.

15 Claims, 7 Drawing Sheets

FIXING APPARATUS HAVING A TRANSPORT MECHANISM AND A CONTROLLER FOR CONTROLLING THE TRANSPORT MECHANISM

This application is based on application No. 10-74532 filed in Japan, the contents of which are hereby incorporated by reference.

BACKGROUND OF THE INVENTION

1. Field of the Invention

The present invention relates to a fixing apparatus to be used on electronic image forming apparatuses such as copying machines, printers, and facsimiles, in particular to a belt type fixing apparatus.

2. Description of the Related Arts

The fixing apparatus is intended to fix unfixed a toner image recorded on a recording medium such as recording paper and an OHP sheet, and is typically a thermal roller type apparatus.

This thermal roller type fixing apparatus comprises a heating roller and a pressing roller that presses on said heating roller, and the recording medium is passed through a nipping area consisting of these two rollers where the unfixed toner image is fixed on the recording medium due to heat and pressure.

In the meanwhile, a fixing apparatus using a belt has been developed in recent years (e.g., Kokai Hei 6-318001). This belt type fixing apparatus has an advantage that it can be heated more quickly thus providing a quick printing feature, because of its low heat capacity.

Since this belt type fixing apparatus comprises a belt and a contacting member (pressuring roller) that forms a nipping area by means of contacting the belt surface, this nipping area has a wider surface for supporting the recording member than the heating roller type and a longer period of heating by the belt, thus supplying more heat to the toner on the recording member.

As a consequence, it is possible to supply a sufficient amount of heat for fixing the toner image on the recording medium even if a low belt temperature is used, which also contributes to a lower toner temperature after it has passed the nipping area. It also alleviates the deterioration of the toner coagulation power, i.e., prevents excess melting, minimizes the consumption of toner releasing agents, which are indispensable for fixing apparatuses used in full-color image forming apparatuses, and makes it possible to realize compact and simpler releasing agent coating mechanisms.

However, a problem with this belt type fixing apparatus is that, in contrast to the heat roller type where the entire roller is heated, only a portion of the belt is heated due to the fact one of the rollers on which the belt is wound around is used as a heat source.

Moreover, it is difficult to heat the entire belt to a uniform temperature even if a low heat capacity belt is used, as the belt is being heated while it is circulated. Temperature fluctuation in the belt transfer direction is more conspicuous during the initial period of heating.

Image luster fluctuation and deterioration of image quality as a result can be a problem caused by sending recording media into the nipping area having such a temperature fluctuation.

SUMMARY OF THE INVENTION

The present invention controls the transport mechanism that transports the recording medium to the nipping area depending upon the belt temperature. This eliminates the deterioration of image quality caused by temperature fluctuation of the belt particularly in the initial heating stage in the belt type fixing apparatus.

The present invention prohibits the transport of the recording medium to the nipping area until the belt temperature reaches a specified temperature. This prevents the deterioration of image quality as it controls the fixing operation based on the belt temperature.

The present invention prohibits the transport of the recording medium to the nipping area until the belt has cycled a specified period after the power source is turned on. This prevents the deterioration of image quality as the fixing operation is suspended until after the belt temperature becomes uniform for the entire range of the belt.

The present invention prohibits the transport of the recording medium until after the belt has cycled a specified period and a belt temperature sensor detects a specified temperature. This allows the minimum temperature of the belt for the entire range of the belt to be compared at least once against a predetermined fixing approval temperature after the belt has been heated by the heating means, allowing the minimum temperature of the belt to be more accurately measured and preventing the recording medium from being sent to the nipping area when the belt temperature is lower than the specified fixing temperature, so that the deterioration of image quality can be prevented.

DETAILED DESCRIPTION OF THE INVENTION

It is described a preferred embodiment of the invention referring to the attached drawings.

[Embodiment 1]

Firstly, it is described Embodiment 1 of the present invention.

[Printer]

Figure 1:
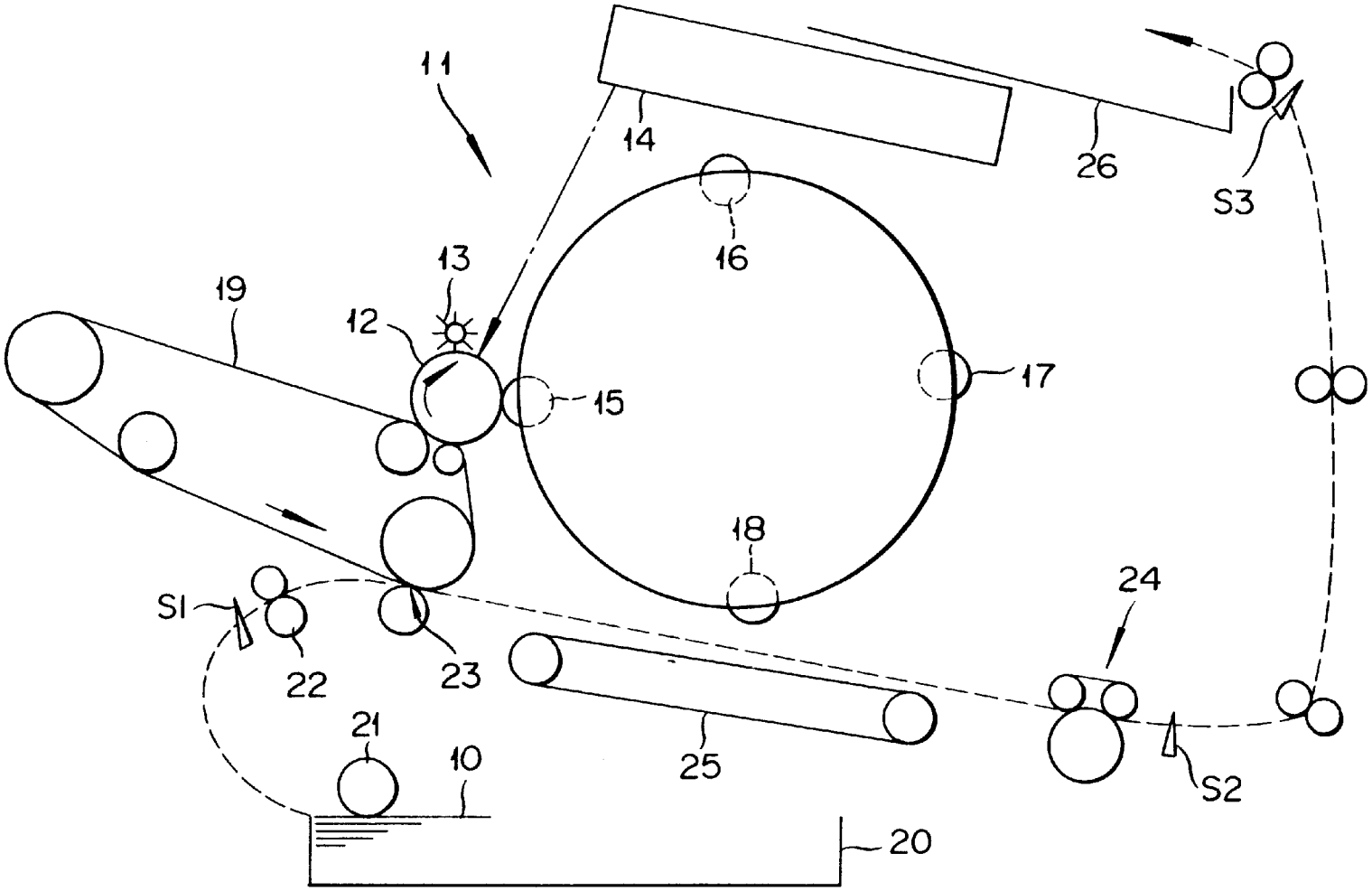
FIG. 1 is a schematic drawing of a printer equipped with a fixing apparatus according to the present invention.

The printer 11 shown in FIG. 1 comprises a sensitizing drum 12, which functions as an image carrier,.and a laser generator 14. The sensitizing drum 12 is rotated in the direction of the arrow, around which arranged are a charging apparatus 13, which charges the periphery of the sensitizing drum 12; a developing apparatus comprising No. 1 through No. 4 developers 15, 16, 17 and 18; a transferring belt 19; and a cleaning apparatus (not shown) that removes toner remaining on the sensitizing drum 12.

Said laser generator 14 drives and modulates a semiconductor laser according to the level of image signals sent from a computer (not shown). The laser light passes through a polygon mirror, an f-θ lens, and a turnaround mirror, all of which are not shown, to be irradiated on the sensitizing drum 12 at a position between the charging apparatus 13 and a developing apparatus. The irradiation of this laser light forms an electrostatic latent image on the sensitizing drum 12.

This electrostatic latent image is first developed as an yellow toner image by means of No. 1 developer 15. This yellow toner image is held on the transferring belt 19 that rotates and moves in the direction of the arrow. Then, the cleaning apparatus removes the remaining toner, the eraser removes the remaining charges, the charging apparatus 13 charges, and the laser light forms a latent image again on the sensitizing drum 12.

The next electrostatic latent image formed on the sensitizing drum 12 is developed into a magenta image by No. 2 developer 16 that comes around and this magenta image is laid over the yellow image already existing on the transferring belt 19.

Similarly, the next electrostatic image is formed on the sensitizing drum 12, developed into a cyan toner image by means of No. 3 developer 17, and overlaid on the toner image on the transferring belt 19. Thus a full color toner image is formed on the transferring belt 19.

No. 4 developer 18 contains black toner and the static image on the sensitizing drum 12 is developed by this No. 4 developer 18 when a monochromatic print is designated.

The printer 11 is removably provided with a sheet cassette 20. This sheet cassette 20 contains multiple sheets of a recording medium (hereinafter called sheet) 10 in a stacked condition. The sheet 10 is discharged one sheet at a time by means of a sheet feed roller 21 and is transported to a transferring area 23 timed with the toner image by means of a timing roller 22.

The full color toner image on the transferring belt 19 is transferred on to the sheet 10 in this transferring area 23 forming an unfixed image on the sheet 10.

The sheet 10 is then separated from the transfer belt 19 and is transported to a fixing apparatus 24 by means of a transfer belt 25.

When the sheet 10 arrives at the fixing apparatus 24, the unfixed toner image is melted and fixed due to heat and pressure, and discharged to a sheet discharge tray 26.

Sheet sensors S1, S2 and S3 are arranged along the transport passage where the sheet 10 is transported to detect the sheet 10, so that control timings can be set for various parts provided in the printer 11 based on the signals of the leading and trailing edges of the sheet 10 detected by sheet sensors S1, S2 and S3.

Members along the transport passage such as the transport belt 25 and the timing roller 22, members of the image forming system such as a transport belt 19 and a sensitizing drum 12, and moving parts of the fixing apparatus to be describe later such as a drive roller are all driven by an electric motor (not shown) through a power transmitting mechanism (also not shown) such as gears or pulleys and belts. Also, the sheet transport speed is synchronized with the rotating and moving speeds of various members.

The aforementioned "image forming system" refers to the components excluding the fixing system that contribute to forming of an unfixed toner image on the sheet.

[Fixing Apparatus]

Figure 2:
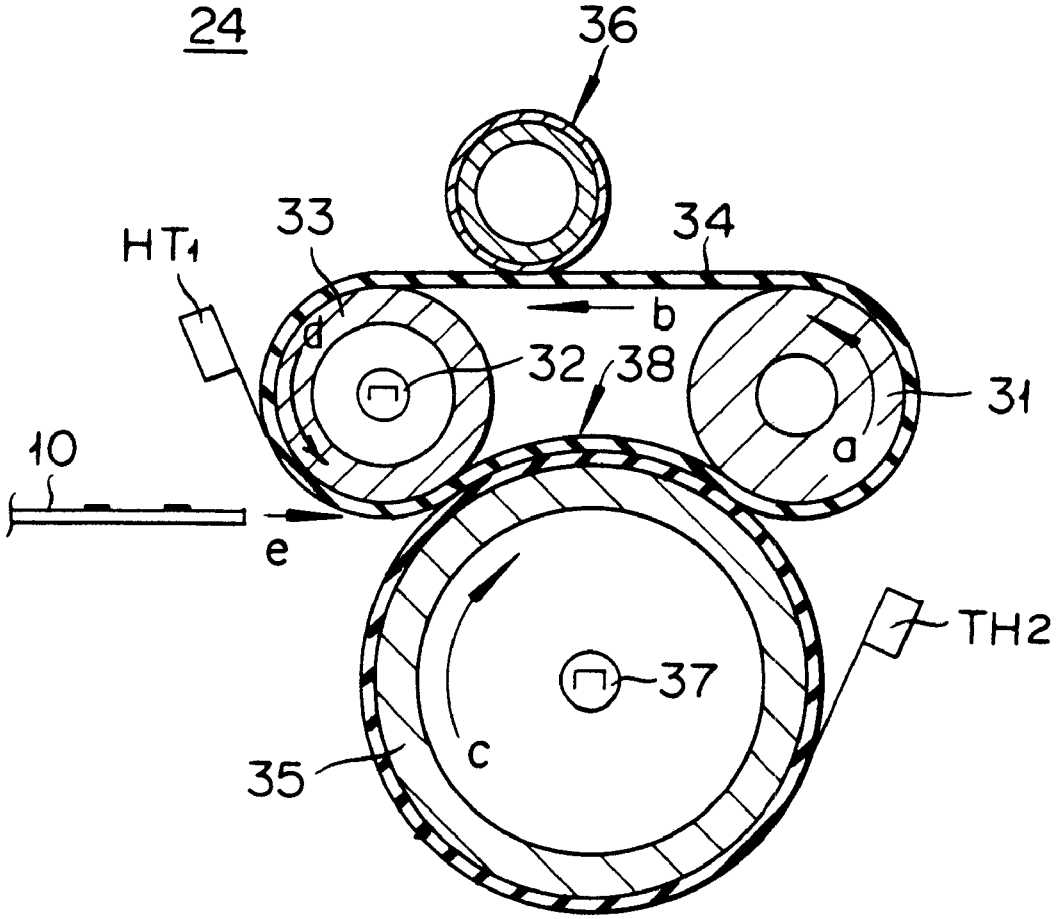
FIG. 2 is a cross section of said fixing apparatus.
Figure 3:
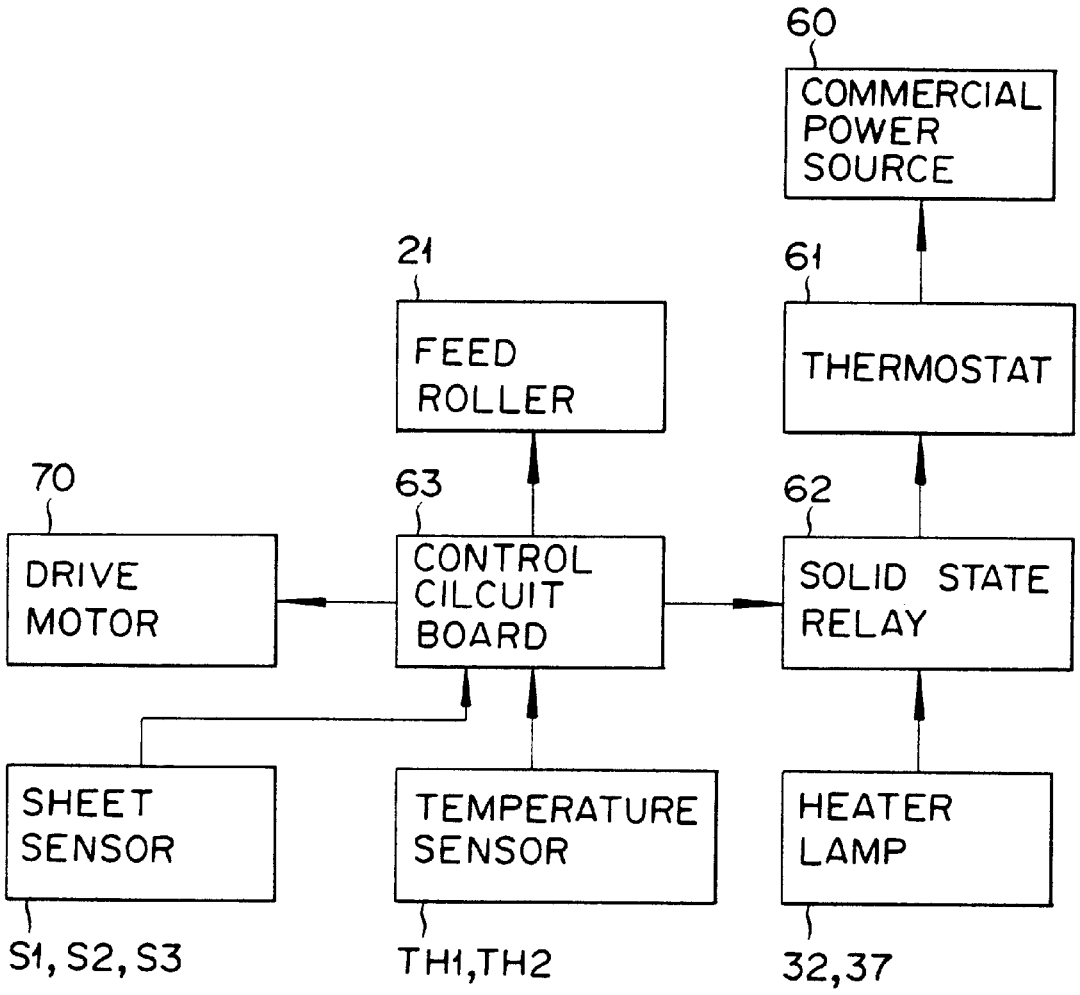
FIG. 3 is a block diagram showing the structure of said printer's controller.

In FIG. 2, the fixing apparatus 24 comprises: a drive roller 31 that rotates in direction of an arrow "a"; a heating roller 33 that contains a halogen heater lamp 32, which is used as a heat source; a fixing belt 34 that spans over the drive roller 31 and the heating roller 33; a contacting member (pressuring roller) 35 that contains a halogen heater lamp 37 and forms a nipping area by contacting the surface of the fixing belt 34; and an oil coating roller 36 that applies a releasing agent (e.g., silicone oil) on the outer surface of the fixing belt 34 to prevent the offset.

While the fixing belt 34 spans over a pair of rollers 31 and 33, at least one of the rollers 31 and 33 (heating roller 33 in the case shown in the drawing) is equipped with a guide member (not shown) on each axial end thereof. These guide members prevent the oblique or snaking motion of the fixing belt 34 and to stabilize the running of the belt.

The fixing belt 34 is a thin seamless belt, preferably consisting of a base made of carbon steel, stainless steel, nickel or heat resistant resin, the surface of which is coated with silicone rubber forming a heat resistant releasing layer that has excellent releasing and heat resistant characteristics against the toner.

More specifically, the thickness of the belt base material of the fixing belt 34 is approximately 40 μm and the thickness of the rubber coating is approximately 200 μm. A typical material for the heat resistant releasing layer is tetrafluoroethylene resin.

The drive roller 31 has a drive gear (not shown) affixed on one end thereof, and is driven in the direction of the arrow "a" by means of a drive means such as an electric motor connected to said drive gear, consequently moving the fixing belt 34 in the direction shown by an arrow "b". The outer periphery of the driver roller 31 is coated with a material with a large friction coefficient (for example, silicone rubber, etc.) so that the fixing belt 34 can be moved securely with no slippage occurring between it and the fixing belt 34.

The heating roller 33 is built as a hollow metallic roller having a halogen heater lamp 32, which acts as the heat source on its axis. A resistance heater or electromagnetic induction heater can be used as the heat source as well. The heating roller 33 preferably is made of a material with a high heat conductivity such as aluminum or copper so that heat can be efficiently supplied to the fixing belt 34.

The contacting member (pressuring roller) 35 is a roller made of a metallic pipe whose outside periphery is coated with rubber or Teflon and is pressed against the drive roller 31 and the heating roller 33 energized by a spring via a fixing belt 34.

As a result, the pressuring roller 35 rotates in the direction of an arrow "c" driven by the friction force between it and the fixing belt 34 when the fixing belt 34 moves in the direction of the arrow "b" driven by the drive roller 31. Another halogen heater 37 is provided inside the pressuring roller 35 similar to the heating roller 33 so that the nipping area 38 can be heated to a uniform temperature by the halogen heater 37.

The temperatures of the heating roller 33 and the pressuring roller 35 are detected by temperature sensors TH1 and TH2. The temperature of the fixing belt 34 can be detected immediately before its passage through the nipping area 38, as the temperature sensor TH1 detects the temperature by directly contacting the fixing belt 34, while the outer periphery temperature of the heating roller 35 can be detected, as the temperature sensor TH2 detects the temperature directly contacting the heating roller 35.

The oil coating roller 36 is placed on top of the fixing belt 34 and contains the oil to be coated on the fixing belt 34. This oil coating roller 36 provides an appropriate tension to the fixing belt 34 by means of a spring and the like to make the fixing belt 34 run in a stable manner as well as to apply the oil to the fixing belt 34 more securely.

Next, it is described how the fixing apparatus 24 operates.

First, when the motor starts to run, the drive roller 31 rotates in the direction of the arrow "a" and the fixing belt 34 runs in the direction of the arrow "b". The heating roller 33 and the pressuring roller 35 are driven in the directions of an arrows "d" and "c" respectively by the fixing belt 34.

After coated with the oil on the upstream side of the heating roller 33, this fixing belt 34 is heated to a specified temperature by the heat from the halogen lamps 32 and 37 through the contacting members consisting of the heating roller 33 and the pressuring roller 35.

In the meantime, the sheet 10 is transported to the nipping area 38 along the direction of an arrow "e38 in such a way that the surface that is holding the unfinished toner image contacts with the fixing belt 34.

When it enters the sheet 10 enters the nipping area 38, it is heated by the heat of the contacting belt 34, and is further transported as it is pressed in the nipping area 38 between the pressuring roller 35 and the fixing belt 34. As a result, the unfixed toner on the sheet 10 is melted as the heat is gradually added to it, and it fixed on the sheet 10 under pressure. The transfer of the toner to the fixing belt 34, i.e., the offset is controlled by the oil applied on the surface of the fixing belt 34.

The sheet 10 that has passed the nipping area 38 is automatically separated from the fixing belt 34 and is transported to the sheet discharge tray 26 (see FIG. 1). The fixing belt 34 whose heat is removed due to the contact with the sheet 10 is replenished with the heat from the halogen heater lamp 32 under a specified temperature control.

This fixing apparatus 24 maintains a stable temperature for the fixing belt 34 and provides an excellent fixing of the toner because the heating of the fixing belt 34 is done after coating it with the oil. Moreover, since the oil coating roller 36 provides a tension to the fixing belt 34, the instability of the fixing belt 34 is suppressed, thus causing the fixing belt 34 to run smooth and stable and contributing to the elongation of the belt life.

[Controller]

The controller controls the operation of various parts of the printer as well as the temperature and timing of the fixing apparatus 24. It comprises primarily a CPU that controls various parts of the printer; a control circuit board 63 that carries peripheral devices such as ROM and RAM, which are not shown; and a solid state relay 62 that supplies the power from the commercial power source 60 to the heater lamps 32 and 37 via a thermostat 61.

The control circuit board 63 controls the temperature of the fixing apparatus 24 based on signals from the temperature sensors TH1 and TH2. The temperature control turns the solid state relay 62 on and off to turn the halogen heater lamps 32 and 33 on and off to control the heat it generates.

Said thermostat 61 is provided in the vicinity of the fixing belt 34 and cuts off the power from the commercial power source 60 when it detects an abnormally high temperature.

The CPU on the control circuit board 63 also controls the entire printer and controls the transportation of the sheet 10 and the formation of the unfixed toner image by means of controlling the sheet supply roller 21 and a drive motor 70 based on the signals from the sheet sensors S1, S2 and S3.

[Control of the Fixing Apparatus]

It is described how the fixing apparatus 24 is controlled.

Figure 4:
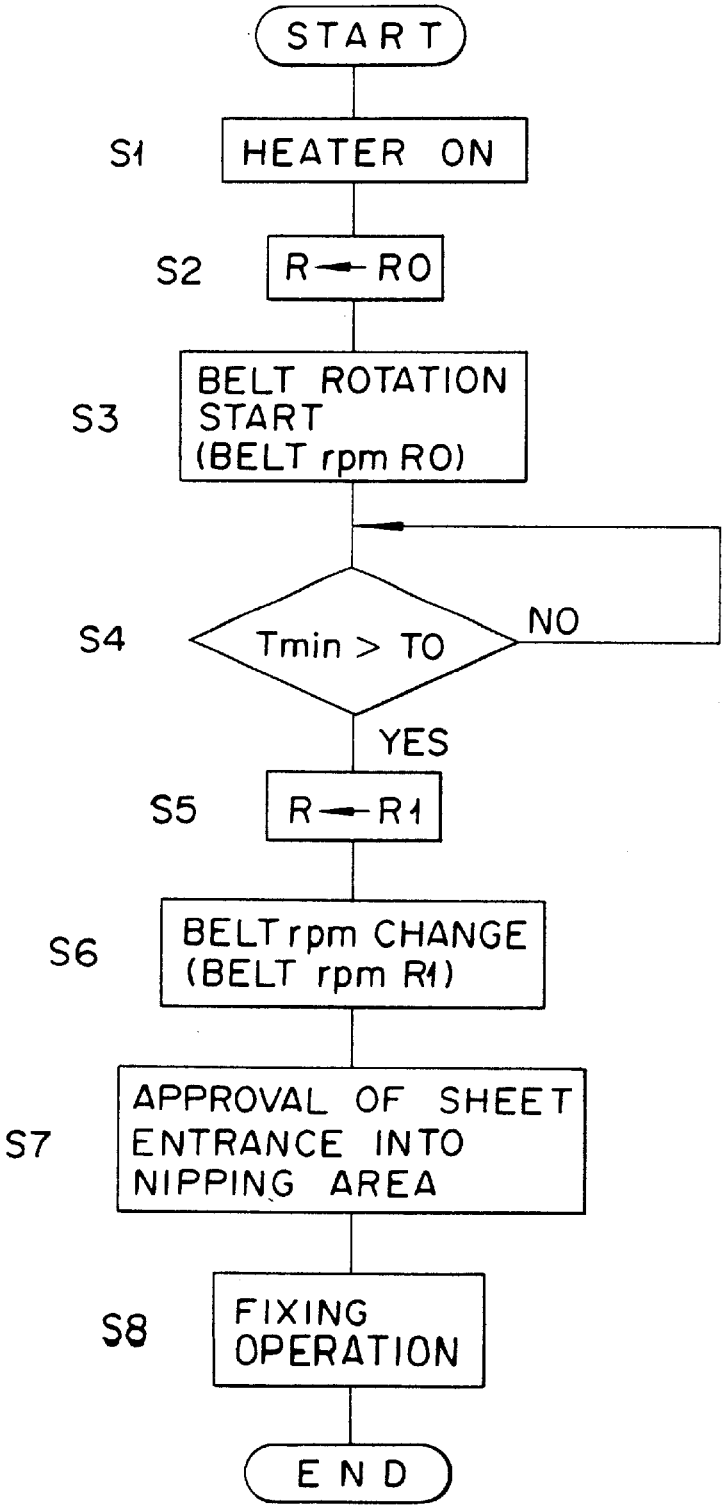
FIG. 4 is a flow chart showing the controlling steps of embodiment 1.

As shown in FIG. 4, the halogen heaters 32 and 37 are turned on (heaters ON) to initiate the heating operation when the start-to-print instruction is entered (S1).

Next, a rotating speed R0 is set up for preparatory rotation of the belt 34, where the letter R stands for the rotating speed (S2). The system starts up the drive motor and starts rotating the belt 34 (S3). The belt speed at this time is R0.

Next, the minimum temperature Tmin of the belt 34 detected by the temperature sensor TH1 is judged whether it has surpassed a predetermined fixing approval temperature T0 (S4). This condition is continued until the temperature of the belt 34 exceeds T0.

When said minimum temperature Tmin is judged to have exceeded the fixing approval temperature T0, the belt rotation speed R is changed to the fixing rotation speed R1 (S5), and the motor speed is changed to achieve this new belt speed (S6). Then, it allows the sheet to enter the nipping area 38 (S7), and begins the fixing operation (S8).

The reason the relation R1>R0 exists is that a slower belt rotation speed R is used during the preparation in order to detect the temperature of the belt 34 accurately considering the response speed of the temperature sensor TH1 and to conduct the fixing operation only after it is securely confirmed that the minimum temperature has been cleared in order to achieve a longer belt life.

The fixing approval temperature T0 is also chosen lower than the proper temperature range for the fixing operation. The reason for this arrangement is as follows. At the start of the printing operation, the heater lamps 32 and 37 are turned on to heat the belt 34 and the sheet 10 starts to travel toward the nipping area 38 as soon as the belt heats up to the fixing approval temperature T0. The belt 34 continues to be heated while the sheet 10 is traveling to the nipping area 38 by the heater lamps 32 and 37 and achieves the temperature suitable for fixing by the time it reaches the nipping area. This allows the printing operation to start without having to wait until the belt temperature reaches the fixing temperature, consequently minimizing the time to complete the printing of the first sheet or the time to complete the entire printing job.

While it is not impossible to rely only on the temperature of the temperature sensor TH1 in this control, the temperatures of both the sensor TH1 and TH2 are used to control the halogen lamp heaters 32 and 37 after the minimum temperature Tmin has been achieved.

Figure 5:
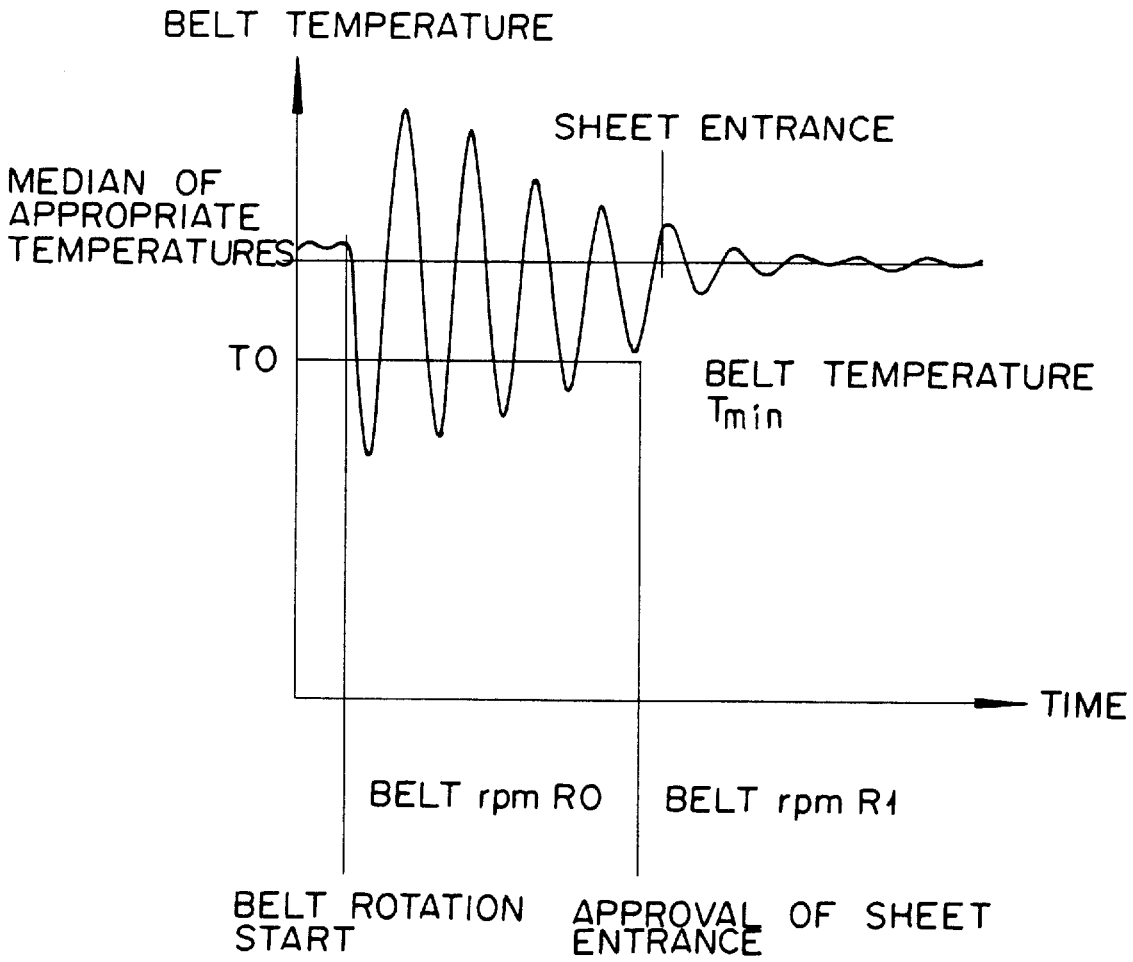
FIG. 5 is a chart showing the belt temperature transition for said fixing apparatus.

FIG. 5 shows the change of the temperature of the belt 34 according to this control. The temperature of the belt 34 shown in FIG. 5 is detected by the temperature sensor TH1.

As shown in the figure, it is so constituted that the temperature of the belt 34 starts to rise as soon as the printing command is provided (not shown), and reaches a temperature higher than the fixing approval temperature T0 before the belt 34 starts to run. This is planned so as to expedite the time required to reach the fixing approval temperature TO by maintaining a higher temperature before the belt starts to rotate, anticipating a temperature drop of the belt 34 as the belt 34 starts to rotate.

When the preparatory rotation of the belt 34 starts, the detected temperature swings up and down violently in the beginning as the heated and unheated areas touches the temperature sensor TH1 reciprocally as the belt 34 moves.

With the movement of the belt, the entire belt gradually becomes a uniform temperature and converges to a set temperature (fixing approval temperature). When the detected temperature exceeds the fixing approval temperature T0, the belt rotating speed is changed to R1, and the sheet 10 is allowed to enter the nipping area 38. As it does not allow any fixing at a lower temperature, this procedure prevents the problem of color images with poor picture quality such as luster fluctuation that otherwise may occur in the early stage of printing.

[Embodiment 2]

Next, It is described the second preferred embodiment of the present invention. Embodiment 2 is different from that of Embodiment 1 in the control operation of the fixing apparatus. Since the constitutions and the basic operations of the hardware, such as the printer and the fixing apparatus, of Embodiment 2 are the same as those of Embodiment 1, they are not repeated here and only the control of the fixing apparatus are described below.

Figure 6:
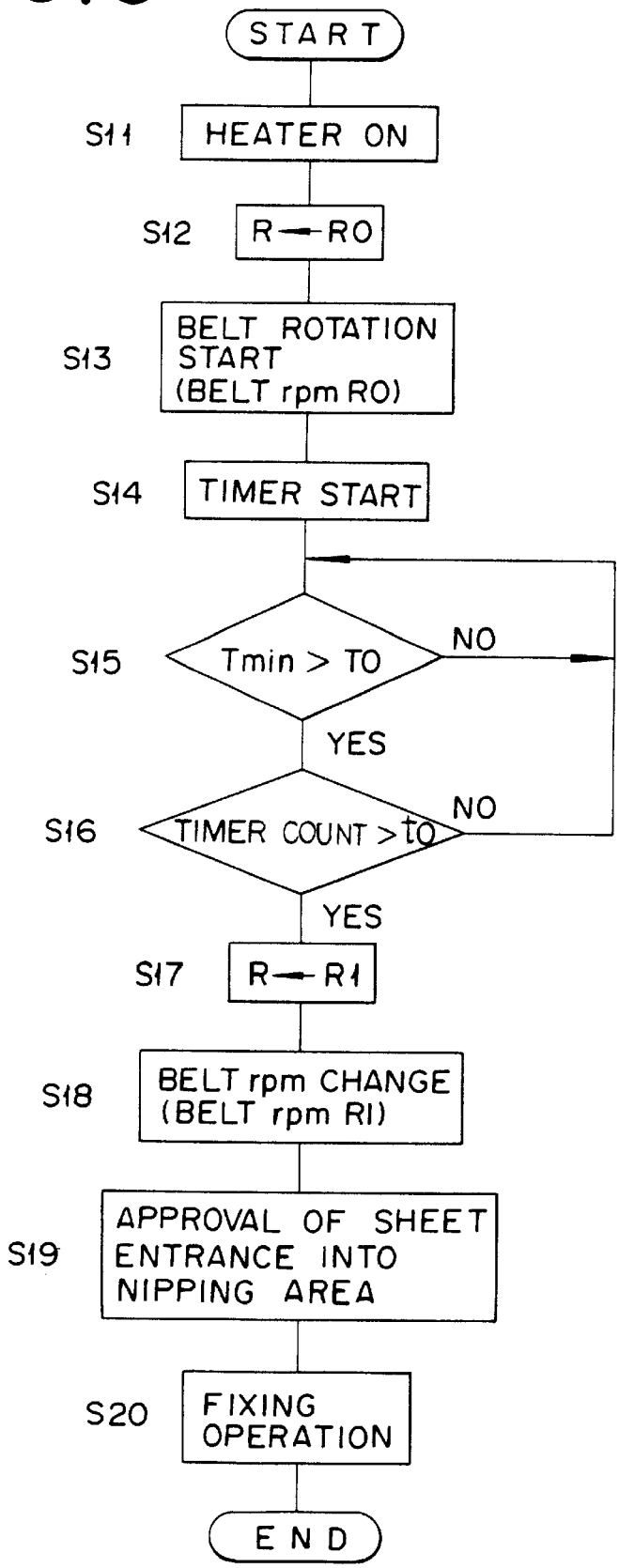
FIG. 6 is a flow chart showing the controlling steps of embodiment 2.

It is described the control steps of the fixing apparatus referring to FIG. 6. First of all, the halogen heaters 32 and 37 are turned on (heater ON) to initiate the heating operation when the start-to-print instruction is entered (S11). Next, after a rotating speed R0 is set up for preparatory rotation of the belt 34, where the letter R stands for the rotating speed (S12), the system starts up the drive motor to start rotating the belt 34 (S13). The belt speed at this time is R0. Simultaneously, the timer is started (S14).

Next, the system detects the temperature of the belt 34 from the signal of the temperature sensor TH1 to judge if the minimum temperature Tmin has exceeded the fixing approval temperature T0 (S15) and holds this condition until it exceeds T0.

If the system determines that the minimum temperature of the belt Tmin has exceeded the fixing approval time T0, it checks if the timer count has exceeded a predetermined value t0 (S16). If the timer count hasn't exceeded t0, the system goes back to the step S15 and continues comparing the minimum temperature Tmin of the belt and the fixing approval temperature T0 until the timer count exceeds t0. When the timer count exceeds the predetermined value t0, the belt rotation speed R is changed to R1 (S17), and the motor speed is changed toachieve the new belt speed(S18). The system then allows the entrance of the sheet into the nipping area 38 (S19) and proceeds to the fixing operation (S20).

Embodiment 2 is different from Embodiment 1 in that the comparison of the minimum detected temperature Tmin with the fixing approval temperature T0 continues for a predetermined time using the timer. It is designed to avoid the temperature measurement error due to the movement of the belt 34 by continuing the temperature measurement until the belt 34 completes at least one rotation with the help of the timer.

In other words, even when the temperature detected by the temperature sensor TH1 exceeds the preset minimum temperature T0, a certain part of the belt 34 has not reached the heating area and the temperature of that part may not have reached T0 until the belt 34 has completed one rotation. To avoid such a case, it is designed to detect the temperature and check if it has exceeded the fixing approval temperature only after the entire belt circumference has passed the heating area.

[Embodiment 3]

Now it is described Embodiment 3. Embodiment 3 is different from Embodiment 1 in the control operation of the fixing apparatus. Since the constitutions and the basic operations of the hardware, such as the printer and the fixing apparatus, of Embodiment 3 are the same as those of Embodiment 1, they are not repeated here and only the control of the fixing apparatus are described below.

Figure 7:
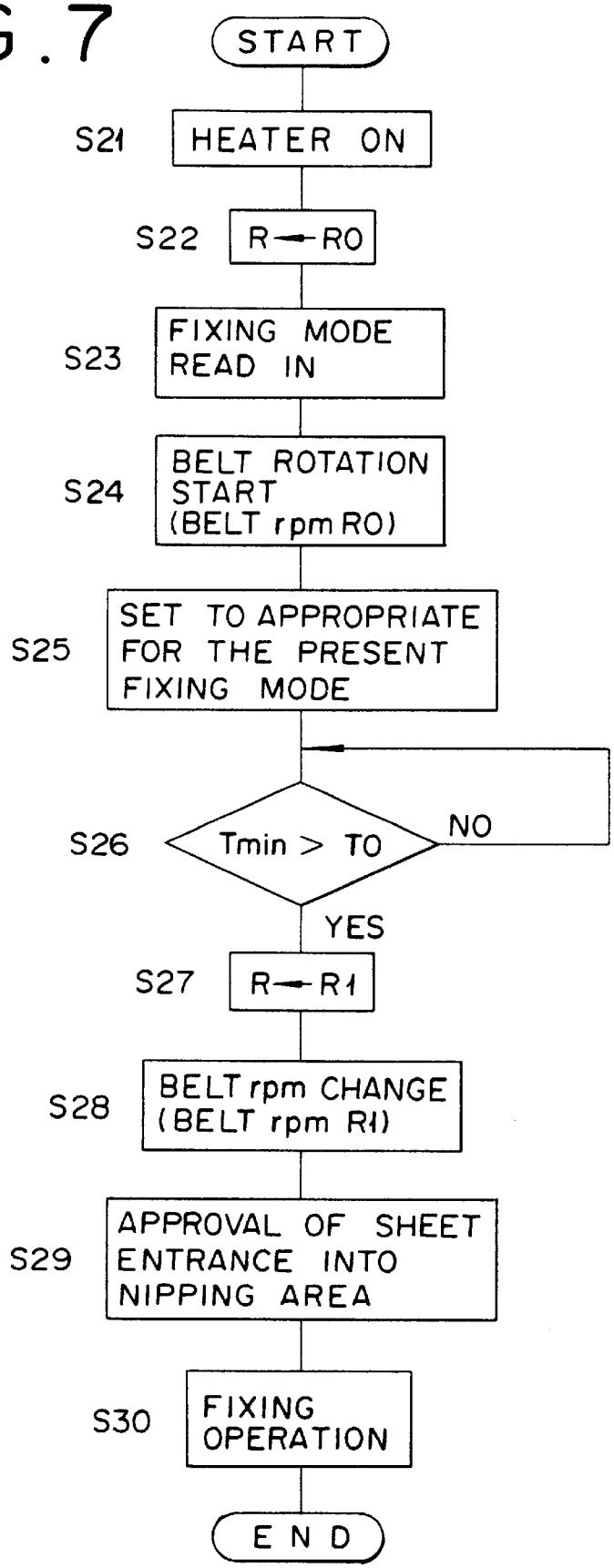
FIG. 7 is a flow chart showing the controlling steps of embodiment 3.

It is described the control steps of the fixing apparatus referring to FIG. 7.

First of all, the halogen heaters 32 and 37 are turned on to initiate the heating operation when the start-to-print instruction is entered (S21).

Next, after a rotating speed R0 is set up for preparatory rotation of the belt 34 (S22), where the letter R stands for the rotating speed, the fixing mode is read (S23). The system starts up the drive motor to start rotating the belt 34 at the speed of R0 (S24).

It reads the fixing mode, which is pre-stored in a ROM of the control circuit board 63, based on the image forming mode by determining whether a color or monochromatic printing is specified in the print data delivered from the printer.

Next, the system sets a fixing approval temperature T0 according to the fixing mode it has read (S25). The fixing approval temperature T0 for color printing is set higher than for monochromatic printing. More specifically, the fixing approval temperature T0 is set to 155°C. for color printing and 140°C. for monochromatic printing.

Next, the system detects the belt temperature from the temperature sensor TH1 to see if the minimum temperature Tmin has exceeded the predetermined fixing approval temperature T0 (S26), and holds this condition until it exceeds T0.

If the system determines that the minimum temperature of the belt Tmin has exceeded the fixing approval time T0, it changes the belt rotation speed R to R1 (S27), and changes the motor speed to achieve the new belt speed (S28). It then allows the entrance of the sheet into the nipping area 38 (S29) and proceeds to the fixing operation (S30).

By selecting the fixing approval temperature T0 depending on the fixing mode, i.e., whether it is color or monochromatic printing, a fixing temperature more suitable for the particular image can be selected, so that the preparation time for fixing operation can be shortened for monochromatic printing, which allows the use of a lower fixing printing temperature, compared to color printing.

The above descriptions of the preferred embodiments of the present invention should not be construed to limit the present invention in any way. For example, they can be combined to provide a different embodiment. Furthermore, it goes without saying that various modifications of these embodiments are possible within the boundary of the gist of the present invention.

We claim:

1. A fixing apparatus comprising:

a belt supported by multiple rollers;

a contacting member that is contacting said belt to form a nipping area;

a driving mechanism that rotates said belt;

a heating member that heats said belt;

a sensor that detects a temperature of said

A transport mechanism that transports recording media to said nipping area; and a controller that controls operations of said transporting mechanism according to the temperature of said belt.

2. A fixing apparatus of claim 1 wherein said controller prohibits the transport of said recording media until the temperature of said belt reaches a specified temperature.

3. A fixing apparatus of claim 2 wherein said controller checks whether the temperature of said belt has reached said specified temperature after said belt has rotated for a specified period after it has started to rotate.

4. A fixing apparatus of claim 2 wherein said controller controls said driving mechanism in such a way as to make a rotating speed of said belt before the fixing operation slower than the rotating speed during the fixing operation.

5. A fixing apparatus of claim 2 wherein said controller controls the temperature of said belt higher than a temperature appropriate for fixing while said belt is stopped.

6. A fixing apparatus of claim 2 wherein said specified temperature is set lower than the temperature appropriate for fixing.

7. A fixing apparatus of claim 2 wherein multiple temperatures can be set as said specified temperature depending on image forming modes.

8. A fixing apparatus comprising:

a belt supported by multiple rollers;

a contacting member that is contacting said belt to form a nipping area;

a driving mechanism that rotates said belt;

a heating member that heats said belt;

a sensor that detects a temperature of said belt;

a transport mechanism that transports recording media to said nipping area; and a controller that controls said transport mechanism in such a way as to prohibit transport of recording media until the temperature of said belt reaches a specified temperature.

9. A fixing apparatus of claim 8 wherein said controller prohibits the transport of said recording media until the temperature of said belt reaches a specified temperature.

10. A fixing apparatus of claim 8 wherein said controller controls said driving mechanism in such a way as to make rotating speed of said belt before the fixing operation slower than the rotating speed during the fixing operation.

11. A fixing apparatus of claim 8 wherein said controller controls the temperature of said belt higher than a temperature appropriate for fixing while said belt is stopped.

12. A fixing apparatus of claim 8 wherein said specified temperature is set lower than the temperature appropriate for fixing depending on image forming modes.

13. A fixing apparatus of claim 8 wherein multiple temperatures can be set as said specified temperature depending on image forming modes.

14. A fixing apparatus comprising:

a belt supported by multiple rollers;

a contacting member that is contacting said belt to form a nipping area;

a driving mechanism that rotates said belt;

a heating member that heats said belt;

a transport mechanism that transports recording media to said nipping area; and a controller that prohibits transport of recording media until said belt has rotated for a specified period.

15. A fixing apparatus of claim 14 further comprising a sensor to detect a temperature of said belt, wherein transportation of said recording media is prohibited until said sensor detects a specified temperature after said belt has rotated for a specified period.

* * * * *